US006376989B1

(12) United States Patent
Vollkommer et al.

(10) Patent No.: US 6,376,989 B1
(45) Date of Patent: Apr. 23, 2002

(54) DIMMABLE DISCHARGE LAMP FOR DIELECTRICALLY IMPEDED DISCHARGES

(75) Inventors: Frank Vollkommer, Buchendorf; Lothar Hitzschke, Munich, both of (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/806,135

(22) PCT Filed: Sep. 13, 1999

(86) PCT No.: PCT/DE99/02885

§ 371 Date: Mar. 27, 2001

§ 102(e) Date: Mar. 27, 2001

(87) PCT Pub. No.: WO00/19485

PCT Pub. Date: Apr. 6, 2000

(30) Foreign Application Priority Data

Sep. 29, 1998 (DE) ..... 198 44 720

(51) Int. Cl.[7] ..... H05B 37/02

(52) U.S. Cl. ..... 315/DIG. 4; 315/209 R; 315/DIG. 7; 315/278; 315/246

(58) Field of Search ..... 315/DIG. 4, DIG. 7, 315/291, 246, 274, 276, 277, 278, 209 R, 224, 225

(56) References Cited

U.S. PATENT DOCUMENTS

| | | | | |
|---|---|---|---|---|
| 4,584,501 A | | 4/1986 | Cocks et al. | 313/493 |
| 5,760,541 A | | 6/1998 | Stavely et al. | 313/491 |
| 6,040,662 A | * | 3/2000 | Asayama | 315/291 |

FOREIGN PATENT DOCUMENTS

| | | |
|---|---|---|
| DE | 43 11 197 | 10/1994 |
| DE | 196 28 770 | 1/1998 |
| DE | 198 17 479 | 6/1999 |
| GB | 2139416 | 11/1984 |
| WO | 94/23442 | 10/1994 |

* cited by examiner

*Primary Examiner*—Don Wong
*Assistant Examiner*—Tuyet T. Vo
(74) *Attorney, Agent, or Firm*—Robert F. Clark

(57) ABSTRACT

A description is given of a method for dimming discharge lamps with dielectrically impeded discharges. A continuous or discontinuous power control can be effected by influencing an electric parameter of a pulsed active-power supply and by means of a suitable electrode structure.

31 Claims, 6 Drawing Sheets

DIMMABLE DISCHARGE LAMP FOR DIELECTRICALLY IMPEDED DISCHARGES

TECHNICAL FIELD

The present invention relates to an operating method for a discharge lamp which is designed for dielectrically impeded discharges. For this purpose, the discharge lamp has a discharge vessel filled with a discharge medium, and at least one anode and at least one cathode. A dielectric layer is provided at least between the anode and the discharge medium, in order to produce dielectrically impeded discharges.

The terms anode and cathode are not to be understood in this application such that the invention is limited to unipolar operation. In the bipolar case, there is, at least electrically, no difference between anodes and cathodes, and so the statements for one of the two electrode groups then hold for all electrodes.

PRIOR ART

As promising fields of application for the discharge lamps considered here, mention may be made by way of example of the backlighting of flat display screen systems, or the backlighting of signal devices and signal lamps themselves. Reference is made in a supplementary fashion regarding the two last-named points to the disclosure content, hereby referred to, of EP-A-0 926 705. Furthermore, this invention is also suitable for lamps such as the copier lamp, represented in DE-A-197 18 395, with internal electrodes, and to the linear lamp, described in German application 198 17 475.6, with external electrodes. The disclosure content of the cited applications is respectively referred to hereby.

Because of the fact that discharge lamps for dielectrically impeded discharges can be designed in a very large multiplicity of the most varied sizes and geometries and, moreover, avoid the typical disadvantages of classic discharge lamps with mercury-containing filling in conjunction with a relatively high efficiency, it is expected that such discharge lamps will be used increasingly both with regard to their quantitative spread and with regard to their fields of use.

Reference is made to the following documents from the prior art:

DE 196 36 965 A1 exhibits discharge lamps for dielectrically impeded discharges which consequently exhibit a dielectric layer between at least the anode and the discharge medium. In accordance with this document, defined attachment points for individual discharges are created by localized field forcings. The homogeneity of the power distribution is intended thereby to be improved both in regard to time and in regard to space.

DE 197 11 893 A1 largely corresponds to the document just cited, and takes the teaching thereof further by using a denser arrangement of the attachment points in the edge region of the lamp or, alternatively, by increasing the current density through individual discharges burning there to counteract edge darkening by widening the anodes.

DE 41 40 497 C2 exhibits an ultraviolet high-power radiator with dielectrically impeded discharges in which the electric power converted in the edge region is increased by varying the discharge spacing or the dielectric capacitance in order to improve the homogeneity of the UV emission.

DE 42 22 130 A1 is concerned within the framework of dielectrically impeded discharges with the starting aid function of local field distortion structures, for example quartz drops melted onto discharge vessel walls, or dents or humps in the walls.

U.S. Pat. No. 5,760,541 describes a discharge lamp with strip-shaped electrodes whose geometric shape leads to a field modulation in the discharge lamp owing to sinusoidal edges, cutouts and other possibilities. The aim thereby is to eliminate temporal fluctuations in a bright/dark distribution in the discharge lamp in order to permit a temporally constant spatial correction of these heterogeneities for the benefit of applications in scanning devices for transparent media.

DE 196 28 770 relates to measures for optimizing the power output of a traveling-wave tube amplifier element at transponder level for satellite applications, in order to stabilize the output power of the overall amplifier system with regard to changes in the operating point, ageing, frequency changes, temperature fluctuations etc.

GB 2 139 416 describes the spatial modulation of the emission of radiation from an electron irradiation device by means of specific spatial arrangements of permanent magnets and magnetic materials.

U.S. Pat. No. 4,584,501 describes a discharge display in which various discharge paths are switched by mechanically actuated flaps, and optical effects are produced by multiple reflections by using semipermeable mirrors.

DE 198 17 479, published after the priority date, relates to the division of the electrode arrangement in a silent discharge lamp into different groups, which can be operated separately.

DE 43 11 197 describes the pulsed operating method, which is essential for the discharge lamps considered here, and the coordination of parameters in order to produce a specific type of discharge.

SUMMARY OF THE INVENTION

This invention is based on the technical problem of providing a further contribution to widening and improving the possibilities of use of discharge lamps for dielectrically impeded discharges.

This problem is solved according to the invention by means of an operating method for a discharge lamp having a discharge vessel, containing a discharge medium, an electrode arrangement with an anode and a cathode, and having a dielectric layer between at least the anode and the discharge medium, the electrode arrangement being inhomogeneous along a control length in a way which varies a burning voltage, by virtue of the fact that it defines along the control length a discharge spacing which varies monotonically at least in a local mean value, and it holds for the quantitative ratio between a difference between a maximum arcing distance $d_{max}$ between the electrodes in the control length and a minimum arcing distance $d_{min}$ between the electrodes in the control length and this control length that: $(d_{max}-d_{min})/SL \leqq 0.6$, and an electric parameter of the power supply of the discharge lamp is varied during operation in order to control the power of the discharge lamp.

Furthermore, the invention also relates to a lighting system having the discharge lamp described and having a ballast designed for the method just mentioned.

Preferred design variants relating to the operating method according to the invention and to the lighting system according to the invention are specified in the dependent claims.

Some of these refinements of the invention are also associated with further technical features of the discharge lamp. To this extent, the invention likewise relates to the correspondingly configured discharge lamp.

As is already to be gathered from the preceding general formulation of the invention, the invention is directed toward power control in discharge lamps with dielectrically impeded discharges. It provides for this purpose at least one control length along the course of the electrode in the discharge lamp. This term denotes a segment of the electrode structure along which inhomogeneous discharge conditions exist. The aim of this inhomogeneity in the discharge preconditions is for a burning voltage of the discharge to vary monotonically along the control length, but at least to vary monotonically in an effective mean value. A particular discontinuous possibility for monotonic variation in the burning voltage is still to be examined further below.

In this case, the term burning voltage relates, in particular, to a minimum burning voltage which corresponds not to the starting voltage of an individual discharge, but to the minimum voltage with which a discharge structure can be maintained at a specific point of the electrode arrangement.

In the case of this invention, it is preferred to consider an operating method in which the active power is injected into the discharge lamp in a pulsed way. Reference is made for this purpose to WO 94/23442 and DE-P 43 11 197.1.

The disclosure content of these applications is hereby also referred to.

In conjunction with this pulsed active-power injection, in this case restarting does not mean restarting of an individual discharge in conjunction with a still remaining residual ionization after one of the regular interruptions or dead times of the active-power injection, which occur in continuous lighting operation in accordance with the pulse principle. Rather, the starting voltage required for restarting means the situation in which the discharge lamp is switched on entirely from new, that is to say without residual ionization still being present in the discharge medium.

A property of discharge lamps for dielectrically impeded discharges which is important in connection with this invention is the positive current-voltage characteristic. Owing to the unambiguous relationship between current and voltage in this characteristic, it is thereby possible by varying the supply voltage also to vary the lamp current by means of the dielectrically impeded discharges. A negative differential resistance opposes this in the case of conventional discharge lamps.

The invention is based on the following observation in conjunction with this variation in the lamp current. A substantial advantage of the pulsed mode of operation referred to here resides in the fact that the dielectric impediment is utilized favorably to such an extent that discharge structures are produced having a shape which is relatively widely fanned out in front of the impeding dielectric. In these typical discharge structures, relatively low charge carrier concentrations, which are of very great significance for the efficiency of the discharge lamp operation, prevail, at least for the predominant portion.

Consequently, in the case of conventional structures lamp current rises are associated directly with an increase in the charge carrier concentrations in the individual discharge structures, and thereby worsen the efficiency of the light production.

Furthermore, excessively high lamp currents lead to a substantial thermal loading on the cathodes (or instantaneous cathodes in the case of bipolar operation), for which the discharge structures exhibit relatively concentrated attachment points. Consequently, the relative cathode points are subjected to punctiform thermal loading. Moreover, an amplified lamp current also increases the erosion effect owing to the ion bombardment at the cathodes, that is to say the sputtering effect of the discharges.

On the other hand, however, disadvantages are also associated with allowing the lamp current to drop below an optimum value, because instabilities can then occur, and individual charge structures can be extinguished or jump back and forth between different points. The spatial and temporal homogeneity of the light production is worsened thereby.

If, in a conventional way, the lamp current is increased beyond an optimum value or drops below this optimum value, this is associated in each case with substantial disadvantages. The invention proceeds from the basic idea of increasing the current in the discharge lamp by varying the total volume of the discharges such that the current density can remain substantially the same in the individual discharge structures. This volumetric change in the discharges can be produced within the control length in basically two different ways. In one case, a single discharge structure is enlarged to form a discharge structure which is widely extended like a curtain. In the other case, a plurality of partial discharge structures are juxtaposed within the control length, such that a variation in the number of these partial discharge structures within the control length varies the total volume of the discharges. The transition between the two cases outlined can also be fluid under some circumstances.

In any case, at least on the anode the discharge structures stretch over a finite range of length along which the discharge preconditions change in the sense of the spatially dependent burning voltage according to the invention. It is possible here for the case of the juxtaposed individual discharge structures to imagine in each case a local averaging for each discharge structure such that the mean values reflect the spatial dependence of the discharge structures. In the case of a discharge structure which widens like a curtain, the spatial dependence of the discharge preconditions is responsible for the fact that the corresponding limit of the discharge structure can be displaced along the electrodes within the control length.

If the spatial homogeneity of the light production plays a substantial role in the discharge lamp, the control length can thus be of relatively small dimension by comparison with the overall size of the discharge lamp, that is to say the discharge lamp can be divided into a plurality of individual control lengths. A variation in the discharge volume within the individual control lengths can then be compensated in a suitable way by averaging the light production, for example by diffusers, prismatic foils or the like. This results overall in a homogeneous character of the light production, there being no need for the power variation owing to an increase or decrease in the current—for example, as a consequence of an increase or decrease in the voltage injection—to be associated with a clearly visible variation in the discharge structures.

There are various possibilities for such an inhomogeneous electrode arrangement for a monotonic spatial dependence of the minimum burning voltage within the control length. What is most important and provided in any case according to the invention consists in a variation in the spacing governing the discharge, the so-called arcing distance, between the electrodes. The larger the arcing distance, the higher is the minimum burning voltage for a discharge over this spacing.

To this extent, the invention is thus directed to an electrode arrangement in which the arcing distance is varied monotonically along the control length, at least in a local mean value.

Moreover, within the scope of the invention a quantitative limitation holds for the relationship between the fluctuations in the arcing distance, that is to say the difference between the maximum arcing distance $d_{max}$ occurring within a control length and minimum arcing distance din and the control length SL itself as path length. The upper limit for this ratio is 0.6, preferably 0.5. The value 0.4 is particularly preferred here.

The ratio just described can also assume very small values within the scope of the invention, as long as it does not vanish. Perceptible effects of the invention can be achieved starting from values as low as 0.01, for example.

In this context, it is possible to explain the difference between the already mentioned starting voltage and the minimum burning voltage to the extent that a discharge at a specific point on the control length with the monotonically varying electrode spacing can certainly ignite an adjacent region with a small spacing and then migrate into the region in which the instantaneous available burning voltage is precisely still sufficient for the discharge. This goes back to the basic phenomenon that the discharge structures are distributed if possible over the available electrode surfaces, because local space charges build up which increasingly shield the electric field in the discharge medium and widen the discharge structure by influencing the field distribution.

However, it is also perfectly possible in the case of the invention for the electrodes to be provided with points (already known per se) for spatial field forcing and thus for localizing individual discharges. It is not directly possible in the case of such structures to move individual discharge structures between these points with a discharge spacing which is sufficiently short in each case to ignite a discharge, and other points at which the spacing only still suffices to maintain a discharge. Specifically, it can happen that the region between the points of local field forcing are even no longer capable of maintaining the discharge.

In the context, discussed here, of the arcing distance or the discharge spacing as determining variable for the burning voltage, such local field forcings can be caused, for example, by small projections or lungs on one or both electrodes. The determining discharge spacing is then measured from the respective tip of such a projection. This means it is possible in this connection for there to be a discontinuous sequence of burning voltages at the respective points, in which case the invention is preferably directed to the case in which these points of local field forcing define a monotonically graded sequence of different burning voltages within the control length.

It may be shown in this case that the burning voltage named in claim 1 can also correspond to the starting voltage for a discharge and not to the minimum burning voltage for maintaining it. Of course, transitions between these extreme cases are also conceivable in the case of the invention. In this sense, the term burning voltage must be understood as being adapted to the respective situation of the electrode arrangement.

In addition to the variation, just discussed, of the discharge spacing for the purpose of influencing the burning voltage, an additional possibility consists in varying the anode width. Firstly, the anode width determines the local anode surface available for the discharge, and thus the discharge current. Again, the discharge current determines the residual ionization of the discharge medium which remains at the end of a dead time interval between two active-power pulses and which determines the probability of restarting and also the restarting voltage. In addition, in the case of a relatively large anode surface, and thus a distribution of the discharge current over a larger surface, there is a smaller voltage drop across the dielectric, and thus a larger electric field in the discharge medium.

Of course, a variation in the anode width can also occur here in conjunction with the described cathode projections, and does not necessarily presuppose substantially smooth cathodes.

Finally, there is also the further possibility of varying the thickness of the dielectric in order, in a way resembling the previous explanation, to influence the discharge current and thus the electric field in the gas filling. An inhomogeneity in the electrode structure can also in this way cause a local variation in a burning voltage of the discharges.

Thus, it is possible in the case of the invention on the one hand to provide a controllable number of individual discharges within a control length, or to influence the individual volumetric extent of a discharge structure respectively assigned to a control length. In the last case, the invention relates to a curtain-like spreading of a discharge structure in the control length by means of a suitable electrode structure with a monotonically spatially dependent burning voltage.

Variants of the invention with a continuous profile of the burning voltage along the control length and with a spatial dependence which is, rather, discontinuous have been explained above. The term of power control is therefore to be understood in general terms as regards the invention. Thus, it can certainly refer to switching the discharge lamp between different discrete power levels, it being possible to prescribe the power levels on the one hand by means of the already described discontinuous electrode structures with points of local field forcing with respectively assigned individual discharges, and also by means of electric levels of a corresponding ballast.

However, the invention is preferably directed to a dimming circuit for a discharge lamp with dielectrically impeded discharges. The term "dimming" in this case means a power control in the case of which a specific dimming range can be traversed in a continuous way, or in an at least approximately continuous way, by the power control. For the case described of a "discontinuous solution", this means that a relatively large number of points of local field forcing must be present within the control lengths, in order to be able to undertake an at least approximately continuous adjustment of the power within this selection of power levels.

So far, control by the voltage at the discharge lamp has been spoken of by way of example in connection with the adjustment of the discharge current and of the discharge volume. However, the invention is to be understood more generally; it is basically an "electric parameter" that is spoken of for adjusting or controlling the power. In this case, in addition to the voltage present across the discharge lamp the following variants come into consideration as regards the pulsed active-power injection:

firstly, the steepness of an edge rise can be influenced in the case of the pulsed active-power injection. This variant relates to a certain extent to the time derivative of the voltage present across the lamp in the region of the rise of the individual pulse. This concerns, firstly, an empirical result of the development work on which this invention is based. A possible explanation of this control option consists, however, in that given a steeper voltage rise, and thus given a stronger participation of radio-frequency Fourier components in the voltage profile, the radio-frequency conductivity of the dielectric, in particular, is improved by comparison with a low-frequency or dc conductivity, and thus the electric field existing in the gas filling is increased, as already explained in another context. Furthermore, a role is played here by a variation in the electron energy distribution by the time derivative of the electric field.

A further time parameter of the active-power supply for influencing the burning voltage in the discharge lamp is what is known as the dead time between the individual active-power pulses, that is to say the time in which no discharge burns between individual pulses. The longer this dead time proves to be, the lower, of course, is the residual ionization remaining in the discharge medium at the end of the dead time. Again, add the probability of restarting or of the voltage required for restarting, depends on the extent of the residual ionization.

Finally, as further temporal parameters of the active-power supply mention remains to be made of the pulse duration and the repetition frequency of the pulses, which can be used in accordance with this invention in a similar way as previously explained in relation to the control of the power.

In order to vary the discharge spacing, it is preferred according to the invention to operate in the region of the continuous variations in the discharge spacing with a sinusoidal shape, at least of one of the electrodes, or with a sawtooth shape of at least one of the electrodes. The sinusoidal shape is formed in a fashion free from tips, that is to say round throughout. Such tips can lead to local field forcing. This can be undesired in some cases. On the one hand, the field forcings can facilitate initial starting. On the other hand, they lead—on one anode—to increased current densities, and can thereby worsen the efficiency of the discharge.

Furthermore, the sinusoidal shape has the advantage that it runs symmetrically to two sides starting from an extreme value, that is to say permits the discharge structure to be drawn open simultaneously in two directions like a curtain. In this case, the centroid of the discharge structure remains constant, in particular, and this can be advantageous with regard to the external appearance of the discharge lamp.

Again, the sawtooth shape can also, of course, be rounded with regard to the tip of the sawtooth which has just been addressed as a possible disadvantage. It can also be bilaterally symmetrical, or else asymmetrical, that is to say the sawtooth shape comprises, for example, a short steep ramp and a long but less steep ramp. An essential point of the sawtooth shape is the linearity of the ramp, that is to say the linearity of the spatial dependence of the discharge spacing. It follows that there are largely identical conditions over the control length between the external intervention in an electric parameter and the resulting spread of the discharge structure—aside from the precise mathematical relationship between the changed electric parameter and the discharge spacing.

However, it can also be precisely desired not to design the tip of a sawtooth shape as rounded. The local field forcing, already addressed, therefore creates in front of a tip directed toward the corresponding counter-electrode a situation which facilitates the initial starting of a discharge. Nevertheless, it remains possible to draw open a discharge structure like a curtain starting from this tip. A corresponding statement also holds for a juxtaposition of a plurality of individual discharge structures within the control length.

A further preferred quantitative relationship between the minimum arcing distance don and the maximum arcing distance $d_{max}$ within the same control length can be specified as follows. A ratio of the minimum arcing distance to the maximum arcing distance of more than 0.3, preferably 0.4 and 0.5, as well as below 0.9 is favorable.

In conjunction with the definition of the control length, it is important to mention that the control length need not necessarily correspond to the maximum possible distance between a minimum electrode spacing described by the geometric electrode structure and a maximum electrode spacing. Consequently, control length means the length of the electrode arrangement actually utilized by the power control according to the invention.

This distinction is important chiefly in the case of electrode structures, for example sinusoidal or sawtooth shapes already addressed, which "can be used" starting from two different sides. Specifically, in the case of a strip arrangement, preferably taken into consideration here, of electrodes on a wall or on opposite walls of a discharge vessel, an alternating sequence of electrodes can be present in such a way that at least some of the electrodes are used for discharges to two sides, in particular to opposite sides. Since the discharges burning to the two sides interfere with one another on the electrode strip, it is possible here, for example in the case of a sinusoidal shape, for a specific part of the sine to be assigned to one possible discharge side, and for another part to be assigned to the other possible discharge side, generally the respectively immediately adjacent part, of course. In particular, it is also possible in this case to provide a certain intermediate section between the regions respectively assigned to other discharge sides, starting from which fundamentally no discharges are to emanate.

With regard to the drawing open of the width of a discharge structure in accordance with the invention, it has proved to be important that any layers situated on the electrodes, in particular on the cathode, are relatively smooth. Troublesome instances of graininess can occur, particularly in the case of phosphors, which are usually deposited in a relatively two-dimensional fashion using the printing method, and can therefore certainly also lie on the electrodes. A sensible quantitative limit is a graininess of 8 $\mu$m, starting from which downward it is possible to open out the width of a discharge structure on such a layer. Of course, instances of smaller graininess of 5, 3 or 1 $\mu$m and less are more suitable. It is to be assumed that the graininess constitutes a basic problem of all layers, and to that extent is not limited to phosphor layers. On the other hand, given the present state of the art the phosphor layers are, in particular, occasionally relatively coarse grained. If, for specific reasons, there is no sufficiently fine grained alternative to a phosphor layer, it is preferred in this case in accordance with the invention to leave the cathode completely free from phosphor, that is to say to omit the deposition of the phosphor. Other layers, for example fine grained reflecting layers made from $TiO_2$ or $Al_2O_3$, are not necessarily affected thereby.

These statements are not, however, to be understood to the effect that the method according to the invention would not be functional with a grainy phosphor layer or another grainy layer on a cathode. Yet further parameters play a role here, for example, the steepness of the rise in the discharge spacing over the control length, and these can be used to permit appropriate drawing open even in the case of grainy layers.

In a preferred variant of the operating method according to the invention, a lamp is driven with the aid of bipolar voltage pulses, that is to say a voltage pulse generated by the ballast is followed by a voltage pulse of inverse sign (polarity). Here, the lamp has a two-sided dielectric impediment, that is to say all the electrodes are covered with a dielectric layer. The bipolar operating method is suitable, in particular, for the electrodes described here which are of the same type from the point of view of discharge physics and can take over in a temporally alternating fashion the role both of a temporary anode and of a temporary cathode.

An advantage of the bipolar operating method can reside, for example, in rendering the discharge conditions in the lamp symmetrical. Problems caused by asymmetrical discharge relationships can thereby be avoided particularly effectively, for example, ion migrations in the dielectric, which can lead to blackening, or to space charge accumulations which worsen the efficiency of the discharge.

A modified forward converter, for example, comes into consideration as ballast for the bipolar operating mode. The modifications aim at providing for a reversal of direction in the primary-side current, which effects the voltage pulse in the secondary circuit, in the transformer of the forward converter. This is generally simpler than making corresponding electrotechnical measures to reverse direction on the secondary side.

In particular, for this purpose the transformer can have two primary-side windings which are assigned in each case to one of the two current directions, that is to say only one of the two directions is used for a primary circuit current. This means that current is applied in an alternating fashion to the two primary-side windings. For example, this can be performed by using two clocking switches in the primary circuit, which respectively clock the current by an assigned one of the two windings. Each of the two current directions is thereby assigned a dedicated clock switch and a dedicated primary-side winding of the transformer.

When a ballast according to the invention is used on an ac source, it can be advantageous with regard to the two primary-side current directions to use two storage capacitors which are charged alternately by half period from the ac source. Thus, the ac half periods of one sign are used for one of the storage capacitors, and the ac half periods of the other sign are used for the other storage capacitor. The currents of one direction in each case can then be extracted from these two storage capacitors. This can be performed together with the outlined dual design of the primary-side winding of the transformer, but such a design is not actually required here. However, a single primary-side winding can be supplied in alternating fashion from the two storage capacitors by corresponding switches, each storage capacitor respectively being assigned to one current direction. In order to feed the storage capacitors from the ac source, use may be made of an appropriate rectifier circuit whose details are immediately clear to the person skilled in the art.

As already stated, the invention is directed not only to an operating method for a corresponding discharge lamp, but also to a lighting system, which denotes a suitable set comprising a discharge lamp and a ballast. In this case, the ballast is designed with regard to the method according to the invention, that is to say the ballast has a power control device with the aid of which a suitable electric parameter of the power supply of the discharge lamp can be influenced by the ballast in order to make use of the appropriately configured discharge structure in the discharge lamp to vary the discharge volume.

To this extent, the above statements relating to the various refinements of the invention also apply likewise to the lighting system, that is to say in each case to the electrode structure in the discharge lamp and to the power control device in the ballast.

With regard to the particular features of the electrode structure explained in the previous description, protection is also claimed for a correspondingly configured discharge lamp, reference being made for this purpose to the corresponding explanations in the previous description.

DESCRIPTION OF THE DRAWINGS

The invention is explained below in further detail with the aid of a few exemplary embodiments. In this case, disclosed features can also be essential to the invention in other combinations or in themselves. In detail:

FIG. 1 shows in four-fold fashion one above another the same electrode arrangement of a straight strip-shape cathode 1 and a sawtooth strip-shaped anode 2. A dielectric cover 4 on the anode 2 is illustrated schematically in the upper region. A period length of the strip structure of the anode 2 is also drawn in as control length SL.

Figure 1:
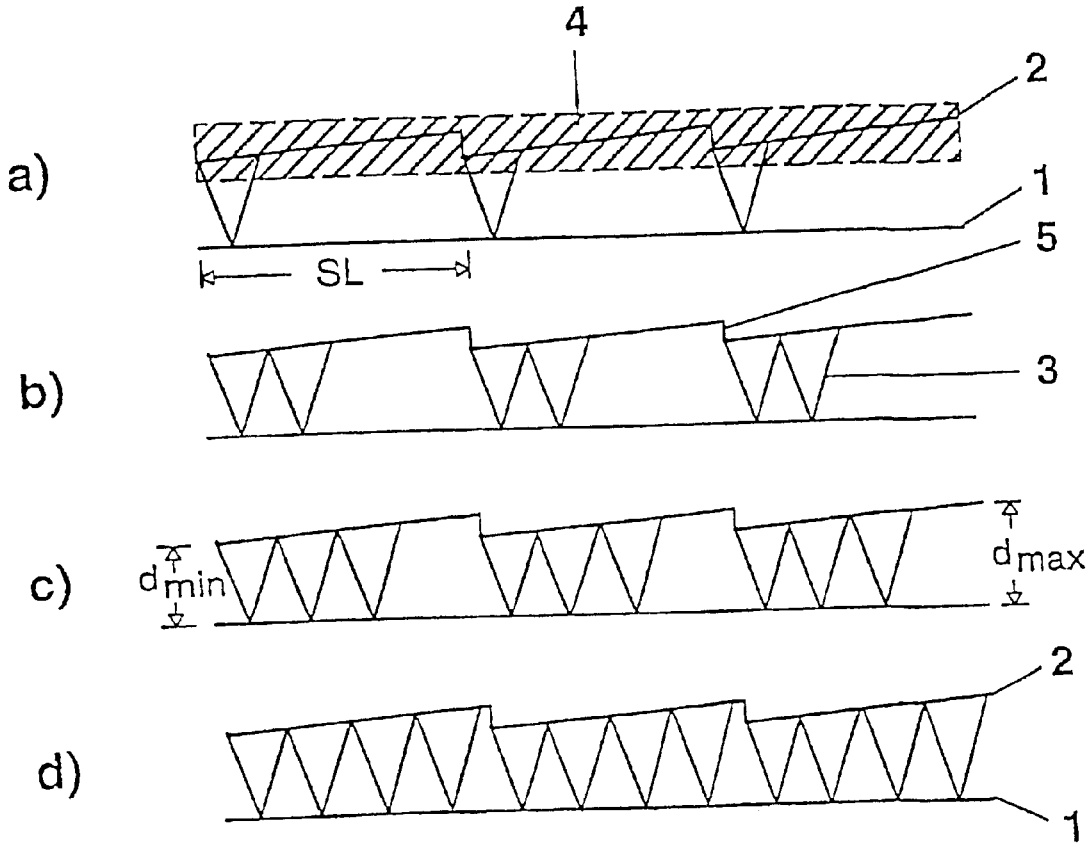
FIG. 1 shows a schematic plan view of an electrode structure with anodes which are of sawtooth shape and illustrated one above another in four power levels.

The triangular discharge structures 3 characteristic of the unipolar pulsed mode of operation of the discharge lamp with dielectrically impeded discharges are located between the electrodes. In the case a) illustrated at the very top, each control length contains a discharge structure 3. In the case b) situated therebelow, a second discharge structure 3 has been added within each control length. A corresponding statement holds for the two further levels c) and d) in FIG. 1, each control length SL being filled up in the lowest level virtually completely by four individual triangular discharges 3. These four illustrations a) to d) depict a dimming range of the discharge lamp from a state with a minimum adjustable power in the uppermost case down to a state with a maximum adjustable power in the lowermost case, each power switching level corresponding to a specific number of individual discharges 3 within a control length SL. At issue here is a power control with a discontinuous variation in the number of individual discharge structures. However, this does not necessarily correspond to a discontinuous power control without the possibility of continuous dimming operation, because it is certainly also possible per se to vary the power of each discharge structure continuously in the spacings between the power levels with a respectively different number of discharge structures.

It is to be seen, furthermore, that the individual discharges 3 firstly, that is to say given the smallest applied supply voltage, burn in the region with the smallest spacings between the cathode 1 and the anode 2, that is to say at the left-hand edge of each control length in the figure, in each case. The minimum discharge spacing, or the minimum arcing distance, occurring at the far left-hand edge of each control length is denoted by $d_{min}$.

The respectively largest arcing distance $d_{max}$ is present within each control length SL at the right-hand edge, and is not reached until the last of the individual discharges 3, juxtaposed within a control length, in FIG. 1 in the lower example.

It remains to be stated in relation to the example illustrated at the very top and having one discharge structure in each case that this discharge structure 3 respectively "attacks" at a tip of the sawtooth shape, thus facilitating its ignition at the very start of operation of the discharge lamp owing to the field lid magnification there. Once one of the discharge structures 3 is prescribed and a certain residual ionization is therefore present in the vicinity, this already facilitates the appropriate ignition of the further discharge structures 3 illustrated.

In order to understand this FIG. 1, it is important not to understand the four pairs of electrodes situated one below another as an overall electrode pattern, because then discharges would likewise burn respectively between the sawtooth-shaped anodes 2 and the strip-shaped cathode 1 of the adjacent structure. Rather, what is involved is four individual illustrations of an exemplary embodiment which is greatly simplified for the purpose of visualization.

Figure 2:
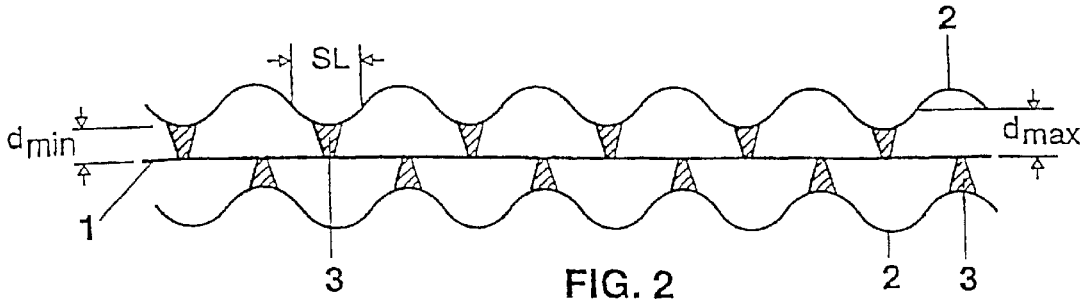
FIG. 2 shows a schematic plan view of a section from an electrode structure with sinusoidal anodes.

By contrast, FIG. 2 shows an alternative to the effect that the anodes 2 in this example run sinusoidally. Here, as well, triangular individual discharges 3 are firstly formed in the region of the minimum discharge spacing.

Figure 3:
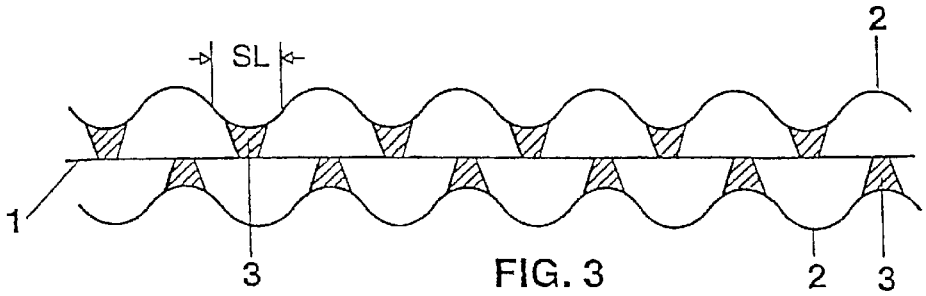
FIG. 3 shows the structure from FIG. 2 in another power level.

FIG. 3 shows the same electrode arrangement by comparison with FIG. 2, comprising a cathode 1 and two anodes 2, but a higher power level is illustrated here. In the example illustrated in FIGS. 2 and 3, no second or third individual discharge structure 3 in addition to that already to be seen in FIG. 2 has been added. Rather, the relatively narrow discharge structure 3 in FIG. 2 is drawn in width like a curtain and now is over both a larger lengthwise section on the sinusoidal anodes 2 and on the strip-shaped cathode 1.

It is to be seen in FIG. 3 that the individual lag discharge structures 3, illustrated here, on the anode 2 have already approximately reached the control length SL illustrated in the left-hand region. By contrast, the same control length SL in FIG. 2 is filled up only to a small extent by the anode side of the discharge structure 3. FIG. 2 and FIG. 3 respectively show only a section from a larger electrode arrangement comprising cathode strips 1 and anode strips 2 situated alternately next to one another. Consequently, the illustrated control length SL does not correspond to the entire period length of the sinusoidal shape, but only to half the period length. The respective half periods with spacings from the cathodes 1 illustrated here which are longer than the illustrated maximum discharge spacing $d_{max}$ are assigned to discharge structures relating to a further cathode 1 (not illustrated).

In the course of the development work on which this invention is based, it emerged as favorable to set a relatively low pressure of a gaseous discharge medium, in particular a Xe discharge filling, in order to facilitate the curtain-like drawing apart of the individual discharge structures within a control length. By way of example, a low pressure in this case can be a pressure of below 80 Torr or else below 60 Torr. In the exemplary embodiments illustrated here, a Xe filling of 50 Torr has proved effective for drawing the structure apart like a curtain. By contrast, a xenon pressure of 100 Torr was selected for examples in which a juxtaposition of individual discharges of varying number is shown without variation in the volume of the individual discharges.

Figure 4:
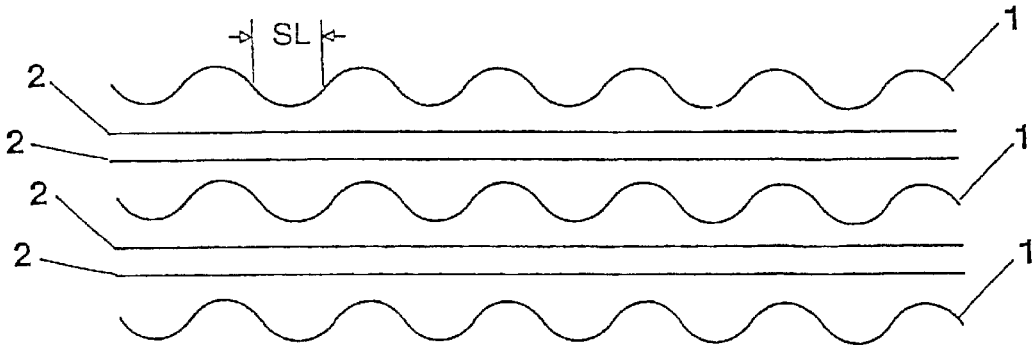
FIG. 4 shows an alternative embodiment to FIGS. 2 and 3.

A further example is shown in FIG. 4, an interchange having been undertaken, however, by comparison with FIGS. 2 and 3 to the extent that here the cathodes 1 have a sinusoidal shape. This sinusoidal shape is, in turn, respectively assigned to half period lengths of two anodes 2 situated on opposite sides of a sinusoidal cathode 1. The straight strip-shaped anodes 2 in this example occur doubled in each case, such that each anode 2 respectively bears discharges only to one side. The geometric variables of control length SL, minimum arcing distance $d_{min}$ and maximum arcing distance $d_{max}$ correspond to the example in FIGS. 2 and 3. Reference is made to the German application 197 11 892.5, whose disclosure content is referred to here, in relation to the technique of double anode design.

Figure 5:
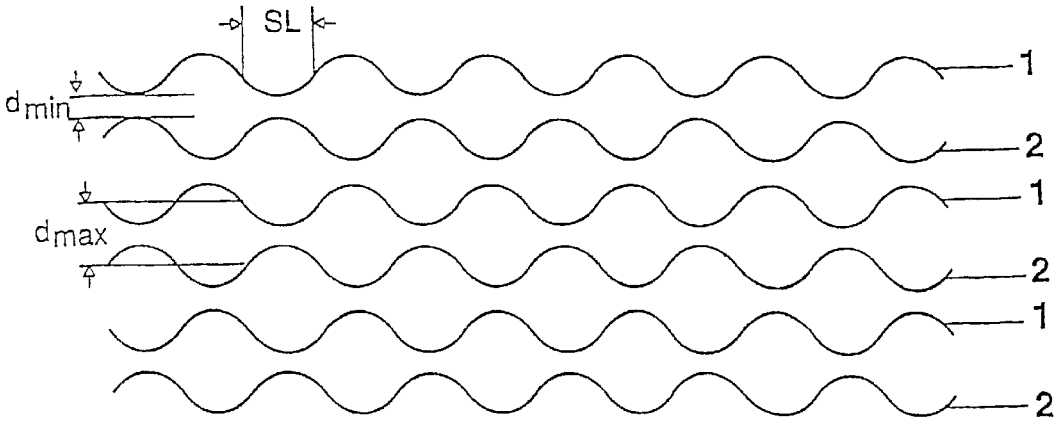
FIG. 5 shows a further alternative embodiment to FIGS. 2, 3 and 4 with sinusoidal cathodes and anodes.

A further variant is shown in FIG. 5, both the cathodes 1 and the anodes 2 being sinusoidal. In this arrangement, the respectively adjacent sinusoidal wave strips are phase-shifted relative to one another by a half period, such that they respectively face one another with their maxima and minima, respectively, and thus the sinusoidal shape respectively produces a modulation of the discharge spacing between the adjacent electrodes.

It holds again, in this case, that owing to the "two-sided function" of each electrode only a half period length occurs in each case as control length SL, and so the maximum arcing distance $d_{max}$ does not correspond to the maximum spacing which actually occurs geometrically.

This structure has the advantage that it is possible to eliminate the twin anode 2 illustrated in FIG. 4 and replace it with a sinusoidal anode 2. In relation to this refinement of the invention, reference is made to the parallel application entitled "Entladungslampen für dielektrisch behinderte Entladungen mit verbesserter Elektrodenkonfiguration" ["Discharge lamps for dielectrically impeded discharges with an improved electrode configuration"], which was filed on the same date of application by the same applicant, and whose disclosure content relating thereto is incorporated here.

Figure 6:
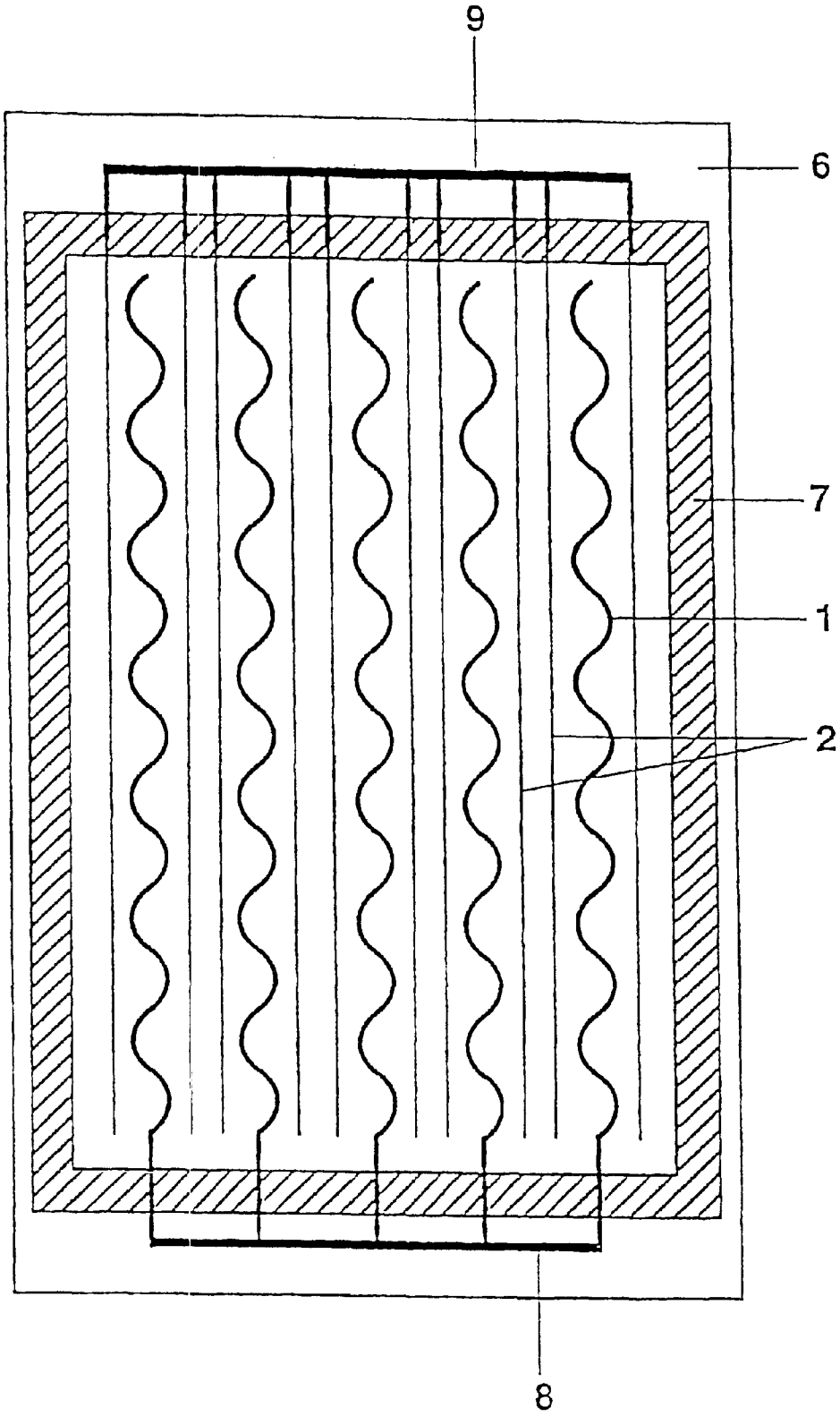
FIG. 6 shows a plan view of a bottom plate of a flat radiator configured according to the invention.

Finally, FIG. 6 shows a more concrete exemplary embodiment corresponding to the structure in FIG. 4. In this case, firstly, 6 denotes a glass base plate of a flat radiator, that is to say a discharge lamp of flat configuration and having dielectrically impeded discharges and two glass plates as main limiting walls. An electrode pattern in accordance with FIG. 4 is applied as metal screen printing pattern to this base plate 6 of the flat radiator. The actual electrodes 1 and 2 are located in this case inside a frame 7 which connects the illustrated base plate 6 to a cover plate (not illustrated) and seals the discharge volume off from the outside. In this arrangement, the electrode strips are simply guided through, under the seal 7 of the glass solder frame, in an extension with respect to their sections its their discharge volume.

Inside the frame 7, the electrode shapes correspond to FIG. 4, that is to say the twin anodes 2 are straight strips and the cathodes 1 have a sinusoidal shape. On the outer side of the frame 7, each of the types of electrodes 1 and 2 is connected jointly to a bus-type outer conductor 8 for the cathodes and 9 for the anodes.

A dielectric of thickness 0.6 mm was used in the exemplary embodiment of FIG. 1, specifically a soft glass layer. A thickness of 250 $\mu$m was used in the examples from FIGS.

2–6, glass solder being involved here. The following values (in mm) were valid for the minimum arcing distances $d_{min}$, the maximum arcing distances $d_{max}$ and the control length SL in the exemplary embodiments in accordance with FIG. 1, in accordance with FIGS. 2 and 3, in accordance with FIGS. 4 and 6 and in accordance with FIG. 5:

| Example | $d_{min}$ | $d_{max}$ | SL |
|---|---|---|---|
| FIG. 1 | 10 | 12 | 31 |
| FIGS. 2 and 3 | 5 | 8 | 8 |
| FIGS. 4 and 6 | 4 | 6 | 9 |
| FIG. 5 | 5 | 9 | 9 |

The power was controlled in the corresponding discharge lamps by varying the voltage amplitude of the pulsed power supply.

In the case of the structure from FIG. 1, two test series were carried out in parallel for illustrative purposes, with a variation in the voltage or the pulse repetition frequency in the case of a fixed voltage amplitude. The respective results are illustrated in the following table, the sequence of the rows of the table corresponding to the four individual illustrations a) to d) in FIG. 1.

| Number of individual discharges per control plane | Voltage U (V) for f = 55 kHz | Frequency f (kHz) for U = 2.8 kV | FIG. |
|---|---|---|---|
| 1 | 2.35 | — | 1a) |
| 2 | 2.40 | 15 | 1b) |
| 3 | 2.45 | 17 | 1c) |
| 4 | 2.49 | 18 | 1d) |

The aim in the cases illustrated in FIGS. 2–6 was to draw open the individual discharge structures 3 like a curtain, and cutouts were provided there for this purpose in the phosphor layers at the locations of the cathodes 1. It is possible to draw open the structures like a curtain even in the case of somewhat higher pressures because of this smoothing of the cathode surface. Consequently, even pressures of 10 kPa with the filling gas Xe were used in these cases.

Figure 7:
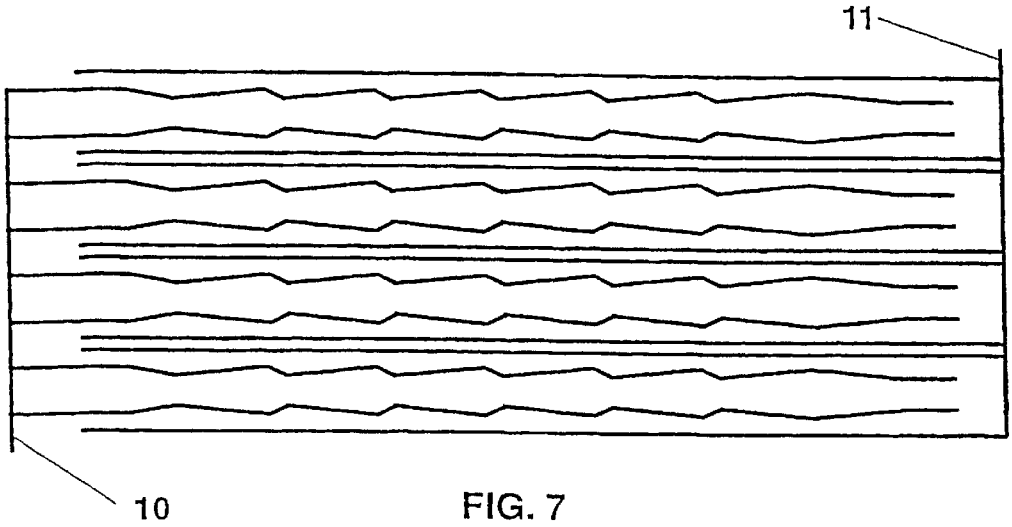
FIG. 7 shows a schematic block diagram of a lighting system according to the invention.

FIG. 7 shows a schematic of the electrode structure of a further flat radiator according to the invention, which is also designed for the bipolar variant of the operating method. The entire electrode structure, comprising a first sort of electrodes 10 of a first polarity and a second sort of electrodes 11 of a second polarity, is therefore covered with a glass solder layer (not illustrated) approximately 150 $\mu$m thick (discharge impeded dielectrically on both sides). The first sort of electrodes 10 comprises a sequence of electrode strips arranged in pairs, all the electrode pairs being connected to one another, that is to say being at the same electric potential. Each pair in this case comprises two mutually mirror-image sawtooth-like electrode strips. Each "sawtooth" of these electrodes has a long flat and a short steep ramp. The long ramp functions as control length. The second sort of electrodes 11 comprises quasi-linear electrode strips which are likewise arranged in pairs between the electrode pairs of the first sort. Moreover, all the quasi-linear electrode strips are oriented parallel to one another and are interconnected, that is to say they are at the same electric potential. The minimum spacing between sawtooth-like electrode strips and immediately adjacent quasi-linear electrode strips, that is to say between a "sawtooth" and the immediately adjacent linear electrode, is approximately 3 mm, the maximum spacing, that is to say between a "notch" and the immediately adjacent linear electrode, is approximately 5 mm. Like the exemplary embodiment in FIG. 6, the discharge vessel (not illustrated) of the flat radiator is formed from a base plate and a front plate as well as a frame. The plates consist of glass of thickness 2 mm and with dimensions 105 mm times 137 mm. The frame height and frame width are each 5 mm. A light-reflecting layer made from $Al_2O_3$ or $TiO_2$ is applied to the base plate and the frame. Following thereupon on all inner surfaces is a three-band phosphor layer. In the case of a unipolar mode of operation and a voltage pulse frequency of 80 kHz, it is possible by using the peak voltage as control variable to control the number of the delta-shaped partial discharges between each "sawtooth" and the immediately adjacent linear electrode. In the case of a peak voltage of 1.35 kV, corresponding to a mean power consumption of 3.5 W, a partial discharge burns in each case between the tip of each sawtooth and the immediately adjacent linear electrode. In the case of a peak voltage of 1.39 kV, corresponding to a mean power consumption of 8 W, two partial discharges burn per sawtooth, being arranged next to one another starting at the tip of a sawtooth, along the longer ramp of the sawtooth, that is to say the control length.

Figure 8:
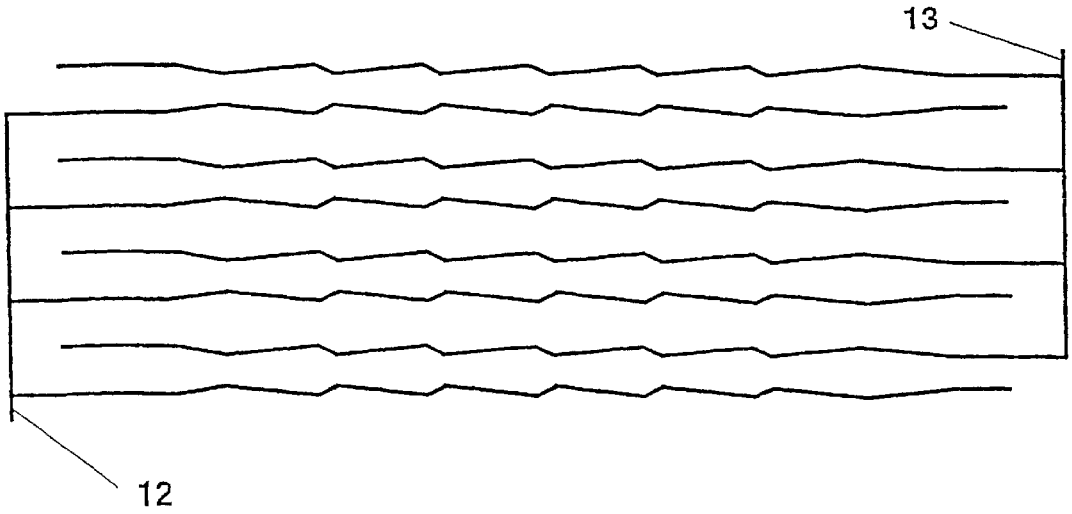
FIG. 8 shows a diagram, corresponding to FIG. 7, with measuring curves for the external voltage and the current through the discharge lamp in the case of the lighting system according to FIG. 7.

FIG. 8 shows a schematic of a variant of the electrode structure in FIG. 7. It differs from that in FIG. 7 essentially in that the second sort of electrode, that is to say the quasilinear electrode strips, is missing here. The sawtooth-like electrode strips are thus combined to form two groups 12, 13 such that two mirror-image electrodes of different polarity are situated opposite one another in pairs in each case. Given an increase in power as described in the description relating to FIG. 7, that is to say with the peak voltage as control variable, for example increased from 1.48 kV to 1.5 kV and, finally, 1.53 kV, corresponding to an increase in power from 2.5 W to 3.6 W or 5 W, the delta-shaped partial discharge, which initially attaches to the tip of each "sawtooth", spreads along the longer ramp of the sawtooth to form a structure which is spread like a curtain and in which individual delta-shaped partial discharges can in any case no longer be distinguished unambiguously by sight. Moreover, with the electrode structure of FIG. 8 this effect can also be achieved with the operating frequency as control variable, for example with an increase from 50 kHz to 111 kHz. It is noteworthy that the peak voltage even decreases here, specifically from 1.53 kV to 1.46 kV. The power consumption increases from 2 W to 5 W.

Further details on the shape and structure of the characteristic partial discharges produced by the pulsed operation of dielectrically impeded discharges, under various operating conditions, are to be found in the already cited Wo 94/23442.

Reference is made to the already cited German application 197 11 892.5 with regard to further technical details of the discharge lamps illustrated here.

Figure 9:
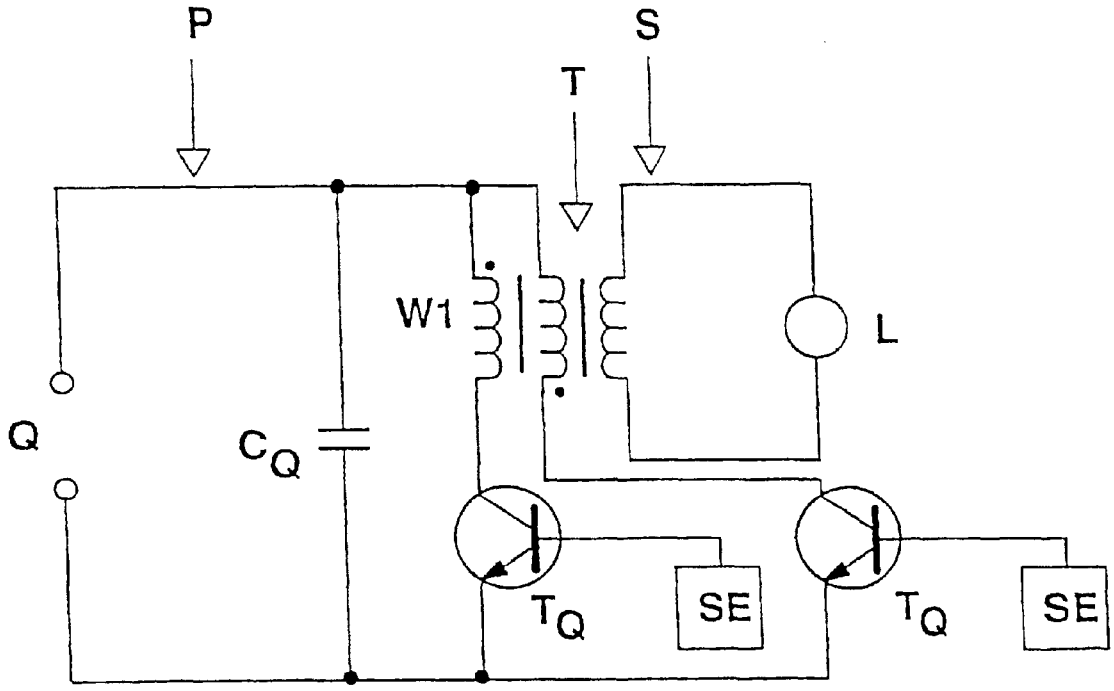
FIG. 9 shows a schematic circuit diagram of a ballast which is suitable for the bipolar variant of the operating method, with a discharge lamp.

FIG. 9 shows a schematic circuit diagram of a ballast which is designed for the bipolar variant of the operating method. Thus, external voltage pulses of alternating polarity are applied to the dielectrically impeded discharge lamp L, for example of the type described in FIG. 7 or 8. For this purpose, the transformer T has two primary windings, which are illustrated in FIG. 9 with an opposite winding sense. Each of the primary windings is connected electrically in series with an assigned switching transistor $T_Q$ with a dedicated control device SE. Of course, the two control devices can also be understood as two functions of an integrated control device; all that is to be symbolized is that the two primary windings are not clocked together, but in an alternating fashion. By reversing the winding sense between the two primary windings, the transformer T respectively produces voltage pulses of opposite polarity in the secondary circuit S upon clocking of the primary windings. To summarize, in the circuit of FIG. 1 the module composed of the primary winding W1, the switch $T_Q$ and the control device SE is of dual design, a reversal of sign being effected by the winding sense.

Figure 10:
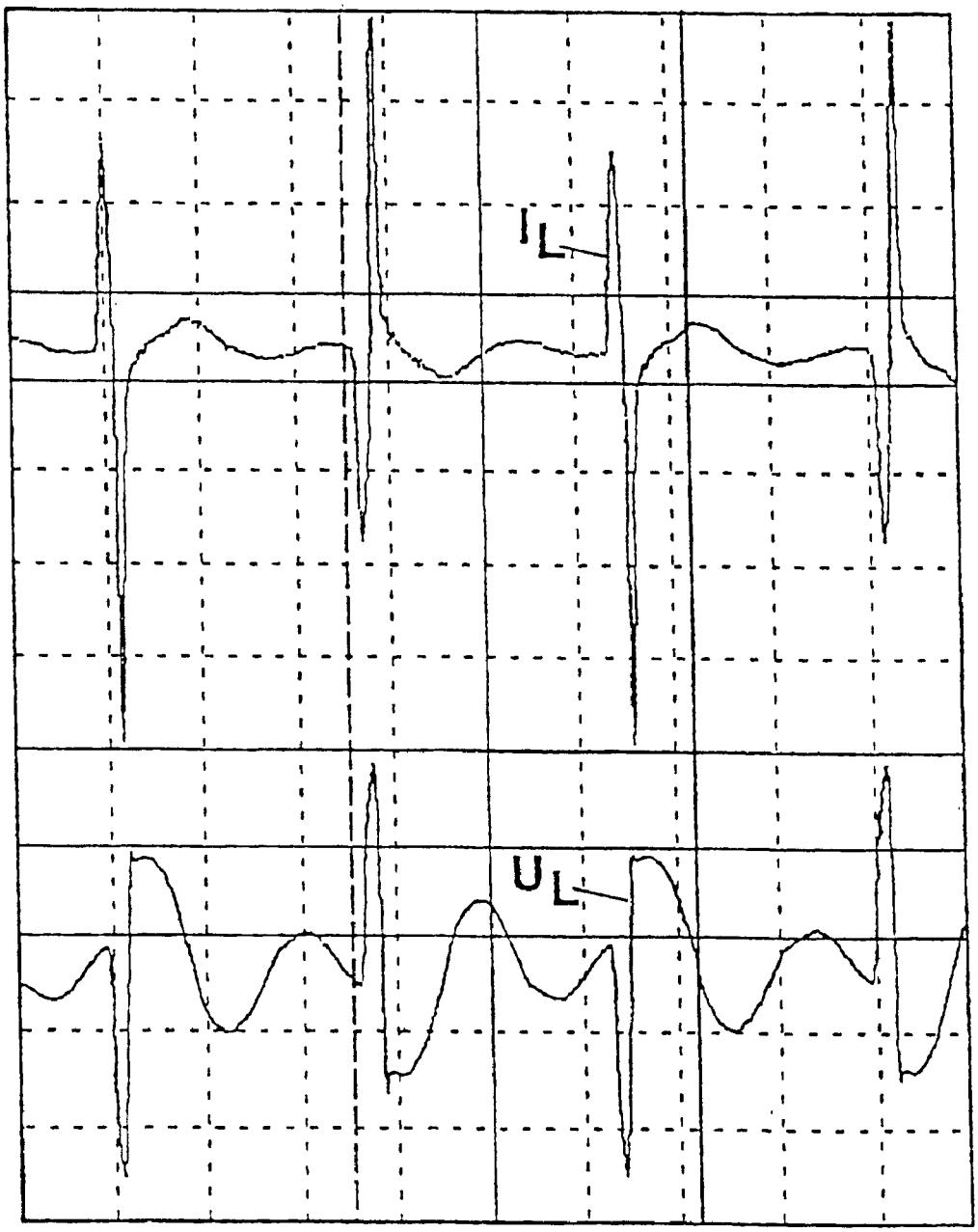
FIG. 10 shows a diagram with measuring curves for the external voltage and the current through the discharge lamp in the case of the lighting system according to FIG. 9.

FIG. 10 shows corresponding real measuring curves of the external lamp voltage $U_L$ and the lamp current $I_L$. It is to be noted here that the measured external lamp voltage $U_L$ is composed of the voltage of the actual pulse and the voltage of the natural oscillation of the secondary circuit. The latter, however, has at least no decisive influence on the discharge. Rather, what is decisive is the actual voltage pulses, which effect the corresponding lamp current pulses of the forward ignition and of the back ignition, and finally result in the active-power pulsed operation already disclosed in WO 94/23442. The fact that a bipolar operating method is involved can be seen both from the ignition pulses of the external lamp voltage and from the lamp current pulses of the forward ignition and the back ignition.

What is claimed is:

1. An operating method for a discharge lamp having a discharge vessel, containing a discharge medium, an electrode arrangement with an anode (2) and a cathode (1), and having a dielectric layer (4) between at least the anode (2) and the discharge medium, the electrode arrangement (1, 2) being inhomogeneous along a control length (SL) in a way which varies a burning voltage, by virtue of the fact that it defines along the control length (SL) a discharge spacing varying monotonically at least in a local mean value, characterized in that it holds for the quantitative ratio between a difference between a maximum arcing distance $d_{max}$ between the electrodes (1, 2) in the control length (SL) and a minimum arcing distance $d_{min}$ between the electrodes (1, 2) in the control length (SL) and this control length (SL) that: $(d_{max}-d_{min})/SL \leqq 0.6$, and an electric parameter of the power supply of the discharge lamp is varied during operation in order to control the power of the discharge lamp.

2. The operating method as claimed in claim 1, in which the inhomogeneity additionally consists in a variation of the thickness of the dielectric layer (4).

3. The operating method as claimed in claim 1, in which the electrodes (1, 2) of the discharge lamp have a number of control lengths (SL) in series.

4. The operating method as claimed in 1, in which the electric parameter of the power supply is varied in a continuous way in order to dim the discharge lamp.

5. The operating method as claimed in 1, in which the electric parameter is a voltage amplitude of a pulsed active-power injection.

6. The operating method as claimed in claim 1, in which the electric parameter is an edge rise steepness of a pulsed active-power injection.

7. The operating method as claimed in claim 1, in which the electric parameter is a dead time of a pulsed active-power injection.

8. The operating method as claimed in 1, in which the electric parameter is a pulse duration of a pulsed active-power injection.

9. The operating method as claimed in claim 1, in which the electric parameter is a pulse repetition frequency of a pulsed active-power injection.

10. The operating method as claimed in claim 1, in which at least one of the electrodes (1, 2) has a sinusoidal shape.

11. The operating method as claimed in claim 1, in which the inhomogeneity additionally consists in a variation of the anode width.

12. A discharge lamp having a discharge vessel, containing a discharge medium, an electrode arrangement with an anode (2) and a cathode (1), and having a dielectric layer (4) between at least the anode (2) and the discharge medium, designed for a method according to claim 11, in which the electrode arrangement (1, 2) along the control length (SL) defines a discharge spacing which varies monotonically at least in a local mean value.

13. The operating method as claimed in claim 1, in which a number of cathode points for local field forcing are present along the control length (SL), these points of local field forcing defining a monotonically graded sequence of different burning voltages.

14. The operating method as claimed in claim 13, in which the number of individual discharge structures (3) varies in conjunction with the power control in the control length (SL), each of the discharge structures (3) being respectively arranged at one of the points of local field forcing.

15. The operating method as claimed in claim 1, in which the discharge volume varies in conjunction with the power control within the control length (SL).

16. The operating method as claimed in claim 15, in which the change in discharge volume is implemented in conjunction with the power control by spreading a discharge structure (3) like a curtain within the control length (SL).

17. The operating method as claimed in claim 15, in which the change in discharge volume is implemented in conjunction with the power control by producing a controllable number of individual discharges within the control length.

18. The operating method as claimed in claim 1, in which it holds that: $(d_{max}-d_{min})/SL \leqq 0.5$, and with particular preference $(d_{max}-d_{min})/SL \leqq 0.4$.

19. The operating method as claimed in claim 1, in which it holds for the quantitative ratio between the minimum arcing distance $d_{min}$ and the maximum arcing distance $d_{max}$ between the electrodes (1, 2) in the same control length (SL) that: $0.3<d_{min}/d_{max}<0.9$, preferably $0.4<d_{min}/d_{max}<0.9$, with particular preference $0.5<d_{min}/d_{max}<0.9$.

20. The operating method as claimed in claim 1, in which layers covering the cathode (1) have a graininess of 8 $\mu$m or less.

21. The operating method as claimed in claim 1, in which the cathode (1) is free from fluorescent layers.

22. The operating method as claimed in claim 1, in which at least one of the electrodes (2; 10; 12; 13) has a sawtooth shape.

23. The operating method as claimed in claim 22, in which the sawtooth shape of the electrodes (10; 12; 13) is formed by an alternating sequence of short steep and long correspondingly less steep ramps.

24. The operating method as claimed in claim 22, in which an electrode with a sawtooth shape and an electrode which is the mirror image thereof are arranged in pairs and parallel to one another.

25. The operating method as claimed in claim 24, in which two parallel linear electrodes (11) are arranged between two adjacent electrode pairs (10) with a sawtooth shape.

26. The operating method as claimed in claim 1, use being made of a ballast with an energized primary circuit (P), a secondary circuit (S) containing the discharge lamp (L), and of a transformer (T) connecting the primary circuit (P) to the secondary circuit (S), the ballast being designed for applying to the discharge lamp (L) external voltages ($U_L$) with signs which alternate from voltage pulse to voltage pulse.

27. The operating method as claimed in 26, in which the primary circuit is supplied from an alternating-current source which charges two storage capacitors alternately by half period, each storage capacitor being respectively assigned to one of the two current directions.

28. The operating method as claimed in claim 26, in which the direction of the current ($I_{W1}$), on the side of the primary circuit, in the transformer (T) alternates from voltage pulse to voltage pulse.

29. The operating method as claimed in claim 28, in which the transformer has two windings (W1) on the side of the primary circuit which are respectively assigned to one of the two current directions.

30. The operating method as claimed in claim 29, in which the primary circuit has two switches ($T_Q$) which in each case clock the current through one of the two windings (W1).

31. A lighting system having a discharge lamp having a discharge vessel, containing a discharge medium, an electrode arrangement with an anode (2) and a cathode (1), and having a dielectric layer (4) between at least the anode (2) and the discharge medium, the electrode arrangement (1, 2) being inhomogeneous along a control length (SL) in a form which varies a burning voltage, by virtue of the fact that along the control length it defines a discharge spacing which varies monotonically at least in a local mean value, and having a ballast, characterized in that it holds for the quantitative ratio between a difference between a maximum arcing distance $d_{max}$ between the electrodes (1, 2) in the control length (SL) and a minimum arcing distance $d_{min}$ between the electrodes (1, 2) in the control length (SL) and this control length (SL) that: $(d_{max}-d_{min})/SL \leqq 0.6$, and the ballast has a power control device for controlling the power of the discharge lamp by varying an electric parameter of the power supply of the discharge lamp.

* * * * *